United States Patent [19]

Lofquist, Jr.

[11] 3,951,576

[45] Apr. 20, 1976

[54] ROTARY DIAPHRAGM PUMP

[76] Inventor: Alden A. Lofquist, Jr., 10 Rita Way, Orinda, Calif. 94563

[22] Filed: Sept. 23, 1974

[21] Appl. No.: 508,236

[52] U.S. Cl. ..... 418/5; 418/15; 418/45; 418/153; 418/220; 259/95

[51] Int. Cl.[2] ..... F01C 5/08; F01C 21/08; F04C 5/00; B01F 5/12

[58] Field of Search ..... 418/5, 15, 16, 45, 152, 418/153, 220; 415/72; 259/95, 97

[56] References Cited

UNITED STATES PATENTS

| | | | |
|---|---|---|---|
| 1,701,103 | 2/1929 | Egy | 415/72 |
| 2,523,588 | 9/1950 | Ormsby | 415/72 |
| 3,229,643 | 1/1966 | Roudaut | 418/153 |
| 3,693,842 | 9/1972 | Cozzarin et al. | 415/72 |

FOREIGN PATENTS OR APPLICATIONS

| | | | |
|---|---|---|---|
| 800,154 | 8/1958 | United Kingdom | 418/45 |

*Primary Examiner*—John J. Vrablik
*Attorney, Agent, or Firm*—Limbach, Limbach & Sutton

[57] ABSTRACT

The rotation of a helix within a deformable tube which is located within and attached by the ends to a pump casing of circular cross section causes fluid to flow between the tube and pump casing when the tube contains at least one longitudinal rib continuously connected to the pump casing. Changes in the cross sectional area of the pump casing and changes in the configuration of the helix permits additional fluid to be drawn into the fluid stream or a portion of such fluid to be discharged from the space between the deformable tube and the pump casing at the transitions in cross sectional areas of the pump casing or changes in configuration of the helix.

9 Claims, 2 Drawing Figures

ROTARY DIAPHRAGM PUMP

BACKGROUND OF THE INVENTION

This invention relates generally to improvements in the design and construction of diaphragm sealed pumps and metering devices by the incorporation of a helix within a tubular diaphragm to achieve continuous fluid flow, and more specifically to employing differing diameters in the pump bore and differeing helix configurations to achieve differential fluid flows to satisfy special requirements.

In accordance with this invention, a tubular diaphragm which is circumferentially deformable and having an inside diameter which is smaller than the minor diameter of a given helix is mounted in a bore of a pump casing with the ends of the tubular diaphragm attached to the pump casing. At least one longitudinal rib of the tubular diaphragm is continuously attached along its length to the pump casing. The bore in the pump casing in which the tubular diaphragm is located may have one or more diameters along its length. A minimum of two fluid passageways through the pump casing provide communication from some external supply of the fluid to be pumped with a volume between the tubular diaphragm and the pump casing, and from the volume between the pump casing and the tubular diaphragm to some external point of use, such fluid passageways generally located at either end of the tubular diaphragm near the points of attachment to the pump casing. Additional fluid passageways between some external points and the volume between the tubular diaphragm and the pump casing are provided at each instance of the change in diameter of the circular bore of the pump casing or the change in configuration of the helix causing pumping action. A helix with a major diameter of such dimensions as to cause the tubular diaphragm to contact and form a fluid seal with the wall of the bore of the pump casing along the ridge line of the helix is mounted within the pump casing and tubular diaphragm. A finite volume cavity is thereby formed by the bore wall of the pump casing, the tubular diaphragm from the point of contact and fluid seal with the bore wall from one ridge of the helix to the next successive ridge of the helix, and from one longitudinal rib of the diaphragm to the next successive longitudinal rib which could also be the opposite side of the original longitudinal rib, such rib being continuously attached along its length to the pump casing and acting to prevent the uncontrolled flow of fluid during the pumping action caused by the rotation of the helix. The fluid cavity thus defined progresses longitudinally along the bore of the pump casing due to the rotation of the helix thereby conveying the fluid being pumped. The end connections of the tubular diaphragm with the pump casing prevent further longitudinal movement of the fluid conveyed in the travelling cavity, and such fluid is appropriately discharged or drawn into the cavity depending upon the direction of rotation of the helix.

The volume of the fluid cavity as defined above may be varied by changing any of several cavity parameters which include the diameter of the bore, the thickness of the wall of the tubular diaphragm, the major diameter of the helix, the minor diameter of the helix, or the pitch distance between the ridge lines of the helix. In addition, more than one longitudinal rib of the tubular diaphragm may be employed thereby increasing the number of separate and distinct fluid flow channels that may be used and concurrently reducing the volume of each of the fluid flow channels.

In the preferred form of the invention as shown in the drawing, the flow of up to four different fluids is controlled by changing both the diameter of the bore of the pump casing and the diameters of the helix to provide for the introduction, mixing and discharge of metered amounts of fluids into the initial flow stream and the eventual discharge of all fluids from the pump.

In other forms of the invention, the fluid flow channels defined by the bore wall, tubular diaphragm and diaphragm ribs may be of different number and dimensions so as to achieve proportional flows of different fluids.

In still other forms of this invention, further variations and changes in bore diameters, diaphragm thicknesses, and helix configurations may be used to achieve specific fluid flow conditions in one or more fluid channels.

In still further forms of this invention, double or triple helixes may be employed instead of the single helix shown in the drawing to achieve specific fluid flow conditions, and the position of the tubular diaphragm with respect to the helix and the bore wall of the pump casing may be varied to achieve varied flow during the operation of the pump.

The principal objective of this invention is to provide a diaphragm sealed pumping device capable of achieving the continuous flow of fluids and the elimination of auxiliary flow control devices such as check valves.

A more specific object of this invention is to provide a pumping device in which several different fluids may be differentially ingested, mixed, metered, and discharged as required for specific operating purposes.

It is another object of this invention to provide a pumping device capable of handling metered quantities of more than one fluid each in separate channels concurrently.

It is a further object of this invention to provide a simple diaphragm sealed pumping device to handle extremely small flows of different fluids in such a manner that metered quantities of other fluids such as diluents or reagents may be added to the initial base fluid or their volume otherwise changed in the course of moving the fluids through the pumping device.

Other objects and advantages of the invention will become apparent upon full consideration of the following description and the attached drawing.

Figure 2:
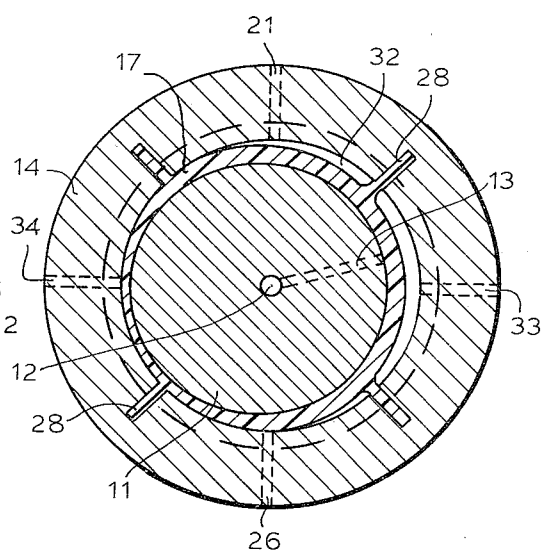
FIG. 2 is a cross sectional view through the pump configuration of FIG. 1 taken generally along line 2—2 showing the multiple flow channels between the tubular diaphragm and the pump casing created by the four longitudinal diaphragm ribs attached to the bore wall of the pump casing. Separate fluid flow passageways between the fluid cavities located between the tubular diaphragm and the pump casing are provided for each of the fluid flow channels as shown.
Figure 1:
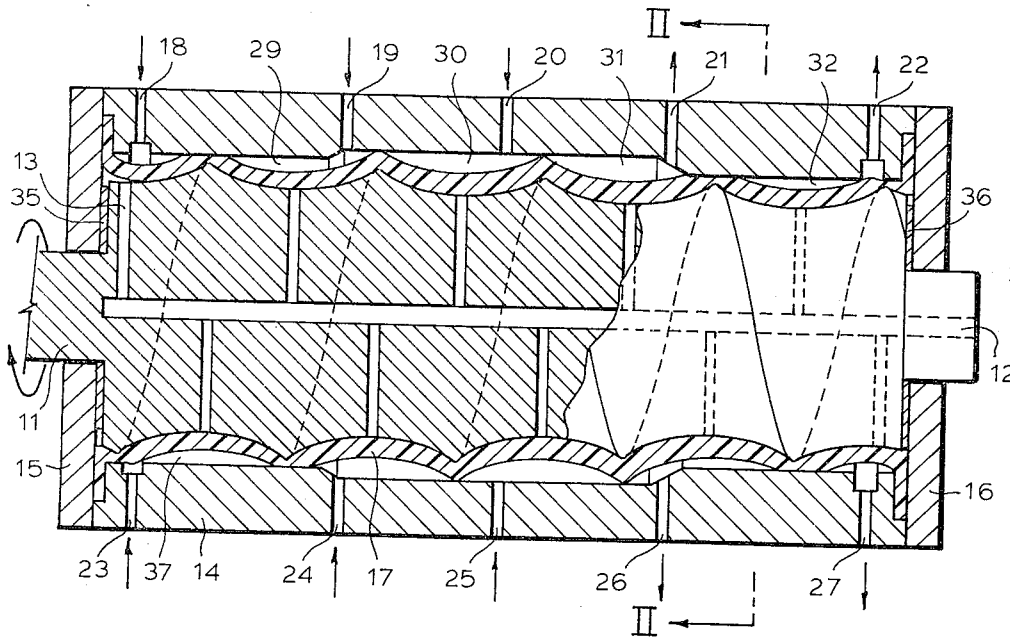
FIG. 1 is a sectional view through one preferred embodiment of the diaphragm sealed pump according to this invention having a rotating helix of two different diameters mounted within a pump casing of different cross sectional areas.

Referring now in detail to both FIG. 1 and FIG. 2, the invention comprises a rotating helix 11 mounted within a tubular diaphragm 17 which in turn is located within and attached to a pump casing 14. The tubular diaphragm 17 is attached to the pump casing 14 by means of end plates 15 and 16 which also serve to locate and support the helix 11. End bearings 35 and 36 further assist in longitudinally locating the helix 11 with respect to the pump casing 14 and also serve as fluid seals.

The tubular diaphragm 17, having a free diameter smaller than the minor diameter of the helix 11, will tend to conform to the configuration of the helix 11 as shown in the drawing. Under certain circumstances however, such as the tubular diaphragm material being less elastic or having a slower recovery rate than desirable, or when the length of the arc of the fluid channel is small due to a large number of such channels, it may be desirable to provide an auxiliary force to assist the tubular diaphragm to conform to the configuration of the helix. This is readily accomplished by causing a pressure less than the pressure of the fluid in the fluid channel between the tubular diaphragm 17 and the pump casing 14 to act on the helix 11 side of the tubular diaphragm 17. FIG. 1 shows a number of passageways 13 connected to a line passageway 12 to permit communication between some external source of pressure which can be varied and the tubular diaphragm 17. Either hydraulic or pneumatic mediums may be used to transmit the auxiliary force to the tubular diaphragm 17. When using a hydraulic fluid particularly as the transmitting medium, it is also possible to control the position of the tubular diaphragm 17 with respect to the helix 11 and the pump casing 14 and thereby further control the volume of fluid being pumped in the fluid channels between the tubular diaphragm 17 and the pump casing 14.

Operating as a pump with the helix 11 being rotated in the direction indicated by the arrow in the drawing, a series of fluid cavities is formed between the bore wall of the pump casing 14, the tubular diaphragm 17 and the longitudinal ribs 28, such cavities progressing from left to right in the drawing. As the ridge of the helix 11 passes the inlet fluid passageway 18 and 23 fluid is drawn through these passageways into the cavity being formed between successive ridges of the helix 11 until the continued rotation of the helix 11 causes the next successive ridge to again seal the diaphragm against the bore wall thereby forming a finite fluid cavity 37.

The combination of the pitch of the helix 11, the number of fluid flow channels formed by longitudinal ribs 28 and locations of the fluid passageways 18, 19, 20, 23, 24 and the like, are of such dimensions that a fluid cavity 37 as previously defined communicates with only one of such fluid passageways 18, 19, 20 at any one time. Preferably the series of cavities is longer than the cavity length so that a seal at one end of a cavity is always interposed between adjacent fluid passageways.

As the fluid cavity 37 progresses from left to right in the drawing, it assumes the form of cavity 29 in travelling past the transition from a smaller bore diameter to a larger bore diameter in the pump casing 14, and the volume of the cavity 29 is thereby enlarged. A fluid passageway 19 is provided in the vicinity of the transition between the different diameter bores to permit fluid to flow into the cavity 29 to fill the enlarged capacity. Although a change in the diameter of the bore in the pump casing 14 in the vicinity of passageway 19 as shown in the drawing may require an equivalent change in the major diameter of the helix 11 to assure a fluid sealing contact between the tubular diaphragm 17 and the bore wall, this fluid sealing contact can also be accomplished by utilizing a tubular diaphragm 17 of relatively large wall thickness as shown in the drawing to accomodate relatively small changes in bore diameters while the major diameter of the helix 11 is held constant. The helix 11 may also be constructed of resilient material to assure contact between the tubular diaphragm 17 and the bore wall.

The minor diameter of the helix 11 is reduced in the section subtending the fluid passageway 20, again causing the volume of the fluid cavity 30 to be increased over the volume of the previous cavity 29 thereby causing additional fluid to be drawn through fluid passageway 20 to be added to and mixed with the fluid cavities from left to right, a substantial reduction in the diameter of the bore of the pump casing 14 occurs in the vicinity of fluid passageway 21 requiring a reduction in both the major and the minor diameters of the helix 11. The fluid cavity 31 is shown in the drawing negotiating the transition section between the different bore diameters and fluid is caused to be discharged from the fluid cavity 31 through the fluid passageway 21 to some external point of use as the fluid cavity assumes the new volume shown as fluid cavity 32. Continued rotation of the helix 11 causes continued progression of the fluid cavities between the tubular diaphragm 17 and the pump casing 14 to the point where the tubular diaphragm 17 is connected to the pump casing 14 by the end plate 16, thereby causing all remaining fluid in the cavity 32 to be discharged through fluid passageway 22 to some external point of use.

The pumping action described above with respect to fluid cavities 29, 30, 31 and 32, and with fluid passageways 18, 19, 20, 21 and 22, is repeated in similar manner for each of the other fluid channels defined between the tubular diaphragm 17, the pump casing 14 and the diaphragm ribs 28 with the associated fluid passageways such as 23, 24, 25, 26 and 27 as shown in the drawing for each of the fluid channels.

It would of course be possible to provide a different bore configuration and a different tubular diaphragm thickness for each of the fluid channels, so long as they would be compatible with the helix configuration, in order to provide different flow characteristics for each fluid channel.

Reversing the direction of rotation of the helix 11 will cause the flow of fluids to be reversed from the process described above.

Differential flows of fluids in a manner similar to the process described above may also be achieved by employing a variety of tapered bores in a pump casing and achieving the differential pumping actions by varying the diameters and pitch distances of an equivalently tapered helix.

This invention also provides for achieving varying flow of fluids within a single fluid flow channel which may occupy less than the full 360° of circumferential coverage shown in the drawing, wherein the diaphragm is less than a tubular shape and is continuously connected to the pump casing at the ends of the diaphragm and along the sides of the diaphragm by the longitudinal ribs. The other functions and variations of the diaphragm sealed pump as described above would continue to be applicable.

Under operating conditions of handling certain fluids which are particularly corrosive, a diaphragm material may be required which has neither the flexibility nor elasticity to be functional except in relatively thin thicknesses. Under these conditions, either or both of the pump casing and the helix may be made of a material or combination of materials that may be sufficiently compressible to cause the diaphragm to make a fluid sealing contact with the bore wall of the pump casing along the ridge line of the helix.

The present embodiments of the invention herein described in the specification and shown in the drawings are only illustrative. Many further modifications to the form and to the type of apparatus employing some configurations of the pump casing, tubular diaphragm, and rotating helix can be made, and the invention can be used in other devices such as meters, compressors, and the like as well as the basic fluid pumping devices described above. In its broadest sense the invention is not limited to use inside a bore but may also be used where one side of the bore may not be closed leaving the working part of the bore as a cavity.

What is claimed is:

1. Apparatus for pumping small volumes of fluids which comprises:

a. a body having an elongated bore therein, b. a tubular diaphragm located in the elongated bore and attached to the body at each end and along at least one longitudinal line on the outer perimeter of the tubular diaphragm thereby defining at least one longitudinal fluid flow channel between the tubular diaphragm and the wall of the elongated bore, c. a helix of such dimensions and mounted within the body in such a manner that the ridges of the helix cause the tubular diaphragm to achieve fluid sealing contact between the tubular diaphragm and the wall of the elongated bore of the body thereby dividing the fluid flow channel into a series of discrete fluid cavities along the fluid flow channel, d. inlet passageway means adjacent to the first end of the tubular diaphragm communicating with the fluid flow channel, e. outlet passageway means adjacent to the second end of the tubular diaphragm communicating with the fluid flow channel, f. means for rotatably mounting the helix within the bore of the body whereby when the helix is rotated the discrete fluid cavities are caused to progressively move from the first end to the second end of the diaphragm within the fluid flow channel, g. means for varying the volumes of the discrete fluid cavities at a selected point along the fluid flow channel, and h. intermediate passageway means including at least one passageway communicating with the fluid flow channel at the selected point where the discrete fluid cavities are changed in volume.

2. The apparatus of claim 1 wherein the elongated bore is of circular cross-section and the volume varying means includes changes in the diameter of the bore along its length with transitionary portions between the bore portions of different diameters and the intermediate passageway means are provided in the vicinity of the transitionary portions for communicating with the fluid flow channel.

3. The apparatus of claim 1 in which the tubular diaphragm is attached to the body along more than one longitudinal line on the outer perimeter of the tubular diaphragm thereby defining more than one, multiple fluid flow channel between the tubular diaphragm and the wall of the elongated bore.

4. The apparatus of claim 1 wherein the volume varying means includes changes in the thickness of diaphragm at selected points along the fluid flow channel and the intermediate passageway means includes passageways for communicating with the fluid flow channel at the selected points.

5. Apparatus as recited in claim 1 wherein the volume varying means vary the volumes of the discrete cavities at a plurality of selected points along the fluid flow channel and the intermediate passageway means include separate passageways for communicating with the fluid flow channel at each selected point where the discrete fluid cavities are changed in volume.

6. Apparatus as recited in claim 5 wherein the volume varying means increases the volumes of the discrete cavities at at least one point and decreases the volumes of the discrete cavities at at least another point along the fluid flow channel and the intermediate passageway means includes an inlet passageway communicating with the fluid flow channel at the points where the volumes are increased and an outlet passageway communicating with the fluid flow channel at the points where the volumes are decreased.

7. The apparatus of claim 1 wherein the volume varying means comprise changes along the length of the helix in at least one of the dimensions of the helix consisting of the major and minor diameters and pitch of the helix.

8. The apparatus of claim 7 wherein the intermediate passageway means include at least one passageway for communicating with the fluid flow channel in the vicinity of the change in helix dimension.

9. Apparatus for pumping and mixing small volumes of fluids which comprises:

a. a body having an elongated cavity therein of circular cross-section, b. a diaphragm located in the elongated cavity and attached longitudinally to the walls of the elongated cavity along opposite sides of the diaphragm thereby defining a plurality of elongated fluid flow channels between the diaphragm and the wall of the elongated cavity, c. a movable member in the form of a helix having a series of ridges and being mounted in the elongated cavity in such a manner that the ridges of the movable member press against one side of the diaphragm to achieve fluid sealing contact between the diaphragm and the wall of the elongated cavity thereby dividing the fluid flow channels into a series of discrete fluid chambers along the fluid flow channels, d. inlet flow means adjacent to the first end of the diaphragm communicating with the fluid flow channels, e. outlet fluid flow means adjacent to the second end of the diaphragm communicating with the fluid flow channel, f. the movable member and the body being rotatable relative to each other to cause the discrete fluid chambers to move along the fluid flow channels from the first end to the second end of the diaphragm, g. the cross-sectional dimensions of the diaphragm, the elongated cavity, and the helix, as well as the pitch of the helix, being such that the spacing between the diaphragm and the elongated cavity wall varies at selected points along the fluid flow channels whereby the volume of the discrete fluid chambers is varied in passing from one selected point to another along the fluid flow channels, and h. intermediate fluid flow means for providing intermediate inlet and outlet fluid communication with the fluid flow channels at the selected points where the discrete fluid chambers are expanded and contracted in volume, respectively.

* * * * *